US005531268A

United States Patent [19]

Hoshino et al.

[11] Patent Number: 5,531,268

[45] Date of Patent: Jul. 2, 1996

[54] HEAT EXCHANGER

[75] Inventors: Ryoichi Hoshino; Hiroki Shibata, both of Oyamashi, Japan

[73] Assignee: Showa Aluminum Corporation, Osaka, Japan

[21] Appl. No.: 345,712

[22] Filed: Nov. 22, 1994

[30] Foreign Application Priority Data

Nov. 24, 1993 [JP] Japan ..... 5-293439

[51] Int. Cl.[6] ..... F28D 1/047; F28D 7/06

[52] U.S. Cl. ..... 165/153; 165/149; 165/176

[58] Field of Search ..... 165/149, 151, 165/153, 173, 175, 176, 177

[56] References Cited

U.S. PATENT DOCUMENTS

| | | | |
|---|---|---|---|
| 2,894,731 | 7/1959 | Wurtz | 165/170 X |
| 3,028,149 | 4/1962 | Pellmyr | 165/149 X |
| 3,273,227 | 9/1966 | Pauls | 165/153 X |
| 3,416,600 | 12/1968 | Fink | 165/175 |
| 3,750,709 | 8/1973 | French . | |
| 4,625,378 | 12/1986 | Tanno et al. . | |
| 4,938,284 | 7/1990 | Howells | 165/149 |
| 5,036,909 | 8/1991 | Whitehead et al. . | |
| 5,190,101 | 3/1993 | Jaillevand et al. | 165/176 |
| 5,205,347 | 4/1993 | Hughes | 165/176 X |
| 5,314,013 | 5/1994 | Tanabe | 165/176 |
| 5,327,959 | 7/1994 | Saperstein et al. | 165/173 |

FOREIGN PATENT DOCUMENTS

| | | | |
|---|---|---|---|
| 0138435 | 4/1985 | European Pat. Off. . | |
| 8584 | 7/1879 | Germany | 165/177 |
| 1900358 | 7/1970 | Germany . | |
| 1-47287 | 6/1989 | Japan | 165/173 |
| 4-187990 | 7/1992 | Japan . | |

*Primary Examiner*—Leonard R. Leo

*Attorney, Agent, or Firm*—Armstrong, Westerman, Hattori, McLeland & Naughton

[57] ABSTRACT

A heat exchanger has flat tubes (1) parallelly arranged and spaced apart from each other a predetermined distance in the direction of thickness. The heat exchanger further has a pair of headers (5, 6) to which the ends of the tubes are connected in fluid communication. Each tube (1) has an intermediate bent portion (4) and straight sections (2, 3) separated one from another by the bent portion, and the bent portion (4) is a portion twisted at a predetermined helical angle relative to each straight section. Fins (11) are interposed between the adjacent straight sections (2), and further fins (12) between the other straight sections (3). The heat exchanger is easy to manufacture and of an improved efficiency of heat exchange, in spite of the tubes being bent in the direction of their width.

21 Claims, 18 Drawing Sheets

HEAT EXCHANGER

BACKGROUND OF THE INVENTION AND DESCRIPTION OF RELATED ART

The present invention relates to a heat exchanger that is adapted for use as an evaporator, a condenser or the like in car air-conditioners, room air-conditioners or the like, and more particularly relates to a heat exchanger comprising heat exchanging tubes which are bent at their intermediate portions between opposite ends.

The heat exchangers recently used in the car air-conditioners are of the so-called multi-flow or parallel flow type. Flat and straight tubes are arranged at regular intervals and in parallel with and spaced apart from each other a predetermined distance in the direction of their thickness. Both the opposite ends of each tube are connected to a pair of hollow headers, in fluid communication therewith.

In the heat exchanger of this type, heat exchange occurs between a medium flowing through the tubes and air streams flowing through air paths each defined between the adjacent tubes. A certain improved heat exchanger is proposed for example in the Japanese Unexamined Patent Publication No. 63-282490. This type is improved in the efficiency of heat exchange and in the drainage of condensed dew, and is of a decreased dimension to fit in a narrower space. Each flat tube in the heat exchanger of this type has, intermediate its opposite ends, a middle portion bent in the direction of its width.

It has however been difficult to protect the tube's internal flow path from collapse when bending it in the width direction.

The U.S. Pat. Nos. 5,279,360 and 5,341,870 propose a method of resolving this problem, in which a plurality of grooves are previously formed along lateral and opposite edges of a tube so that it can easily be bent at its middle region.

There are still problems in those proposals in that the previous forming of many grooves causes much labor and limit the portion where each tube can be bent. In addition, cross-sectional area of the bent portion is so decreased that a pressure loss of the coolant noticeably increases, due to the previously formed groves.

Instead of such a simple bending of tubes in the direction of their width, a 'twisting' of tubes is proposed in another Japanese Unexamined Patent Publication No. 4-187990. According to this proposal, a middle portion located intermediate opposite straight sections of each tube is twisted and bent such that the right side surface of one section becomes the left side surface in the other.

This proposal may be effective to avoid the collapse and constriction of the bent portions. It is however necessary to prepare the bent tubes, before connecting them to the headers, to thereby render somewhat intricate the manufacture and assembly of a heat exchanger. In a case wherein the interior of each flat tube is divided into parallel unit paths, a windward one of them in one straight section will continue to a windward unit path in the other, relative to air stream flowing through a space present between the adjacent straight sections. Consequently, heat exchange efficiency will vary among unit paths in each tube, thus impairing the overall efficiency of heat exchange.

OBJECTS AND SUMMARY OF THE INVENTION

An object of the present invention made in view of the described problems inherent in the prior art is therefore to provide a heat exchanger comprising a plurality of flat tubes arranged at regular intervals and in parallel with and spaced apart from each other a predetermined distance in the direction of thickness of the tubes, both the opposite ends of each tube being connected to a pair of headers in fluid communication therewith, wherein the tubes are bent at their intermediate portions in the direction of their width in such a manner that the heat exchanger is easy to manufacture, pressure loss of a heat exchanging medium flowing therethrough is suppressed, and heat exchange efficiency thereof is improved.

According to the present invention, the heat exchanger comprises: a plurality of flat tubes arranged at regular intervals and in parallel with and spaced apart from each other a predetermined distance in the direction of thickness of the tubes; a pair of hollow headers disposed at one ends and other ends of the tubes, which are connected thereto in fluid communication therewith; each tube having an intermediate bent portion and straight sections separated one from another by the bent portion; the bent portion being a portion of each tube twisted at a predetermined helical angle; and fins each interposed between the adjacent straight sections.

For the purpose of rendering easier the manufacture and improving mechanical strength of the heat exchanger, it may further comprise: additional fins disposed outside the outermost tubes; and reinforcing strips each composed of a middle section and end sections continuing therefrom. The middle section has formed therethrough apertures each fitting on a boundary present between the straight section and the twisted bent portion of each tube, and each end section of the reinforcing strip extending along and fixedly adjoined to the outer surface of the corresponding additional fin.

The twisted and bent portions located adjacent to each other may contact and overlap one another to reinforce said portions as a whole.

It is an important feature that each bent portion is twisted at a predetermined helical angle relative to the adjacent straight sections.

In manufacture, the flat and straight tubes arranged parallel at regular intervals and each having opposite ends connected to the headers in fluid communication therewith may be bent all at once in the direction of tubes' width. Each portion which is being bent between the straight sections will simultaneously and spontaneously be twisted relative thereto. The twisted and bent portions can now be formed very easily, without encountering any technical difficulty.

In a case wherein the heat exchanger comprises the aforementioned reinforcing strips each composed of the middle section and the end sections continuing therefrom and formed perpendicular thereto, the straight sections are protected from deformation during the bending-and-twisting operation. This is because a stress imparted to the tubes which are being bent is restricted to their middle portions located between the middle sections of said strips, even if each tube is forced to have a considerably small radius of curvature. The reinforcing strips thus contribute not only to an easier manufacture but also to an improved overall strength of the heat exchanger.

The overlapping of the adjacent bent portions will further improve their strength as a whole.

BRIEF DESCRIPTION OF THE DRAWINGS

FIGS. 17 to 21 show another heat exchanger provided in a second embodiment and as an evaporator, in which:

FIG. 17 is a front elevation of the heat exchanger;

FIG. 18 is a cross section taken along the line 18—18 in FIG. 17;

FIG. 19 is a perspective view of a tube incorporated in the heat exchanger, and shown in its twisted state;

FIG. 20 is a front elevation of the heat exchanger, shown in its state before being bent; and FIG. 21 is a plan view of the heat exchanger, shown in its further state after bent;

FIGS. 22 and 23 illustrate still another heat exchanger provided in a third embodiment and as a condenser, in which:

FIG. 22 is a perspective view of the heat exchanger, shown in its entirety; and FIG. 23 is a left side elevation of the heat exchanger.

DESCRIPTION OF THE PREFERRED EMBODIMENTS

Figure 1:
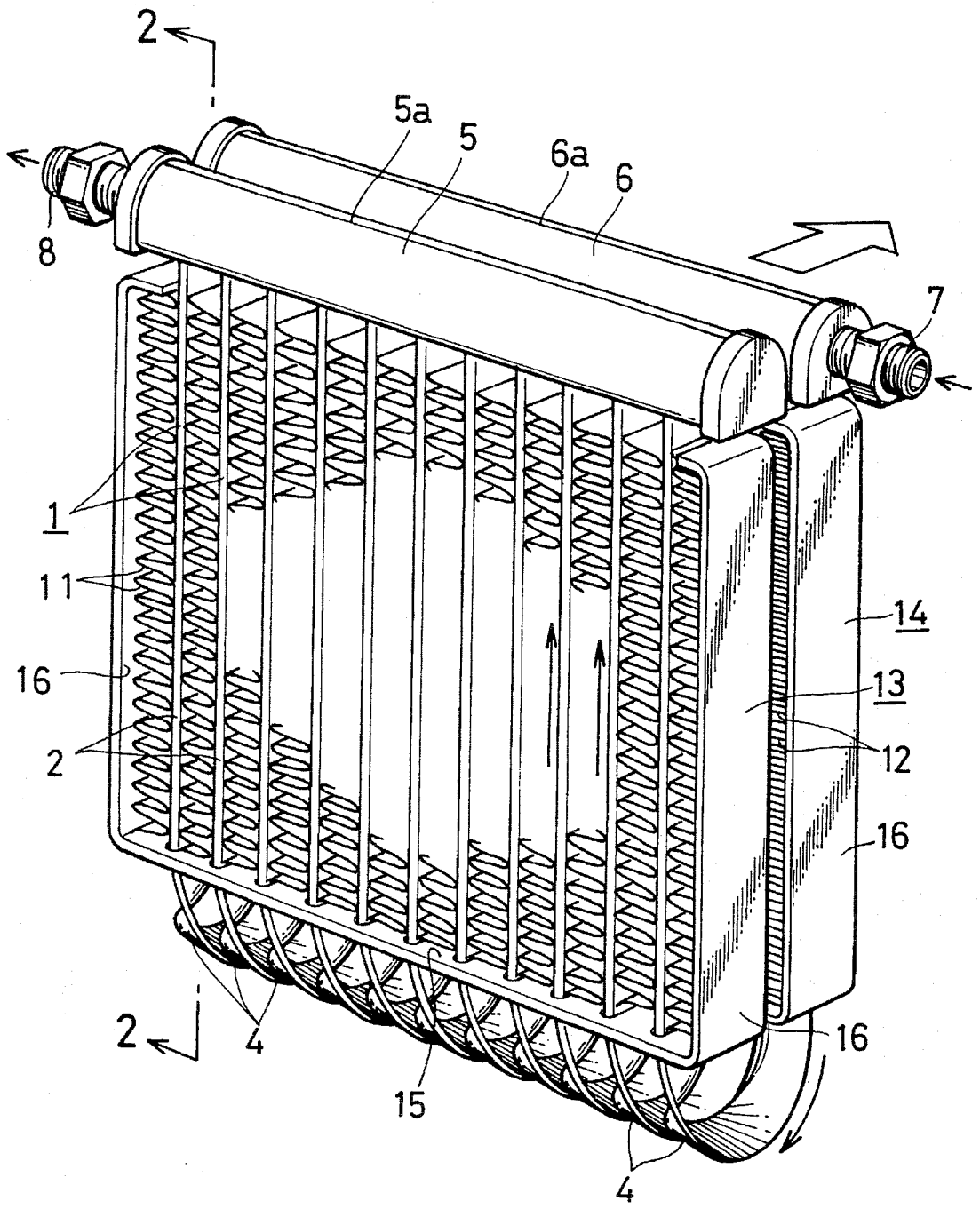
FIG. 1 is a perspective view of a heat exchanger in the form of an evaporator provided in a first embodiment and shown in its entirety.

Now, some embodiments of the present invention will be described referring to the drawings.

First Embodiment

A heat exchanger which FIGS. 1 to 16 illustrate is an evaporator provided in the first embodiment for use in a car air conditioner.

Figure 10:
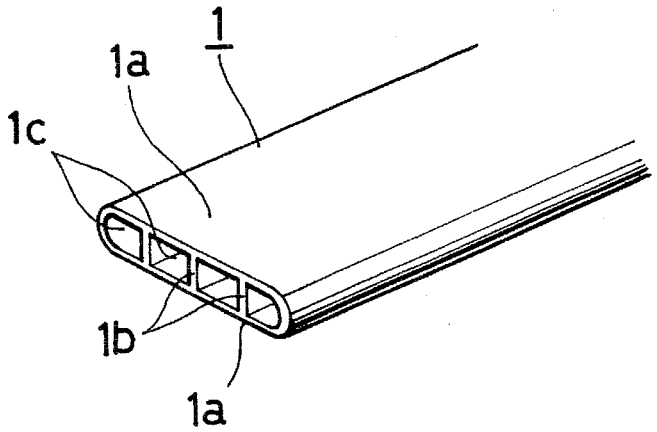
FIG. 10 is a perspective view of the flat tube, shown in part.

Each of flat heat exchanging tubes 1 shown in FIG. 1 is of an elliptic shape in cross section and has an upper and lower flat walls 1*a*. Those flat walls 1*a* are connected one to another by a few connecting walls 1*b* so that several unit paths 1*c* are defined in and longitudinally of the tube, as seen in FIG. 10.

The tubes 1 are aluminum extruded pieces of the so-called harmonica structure in this embodiment. However, they may be flat seam-welded tubes having inserted therein internal corrugated fins, or of any other conventional structure in the present invention.

Figure 2:
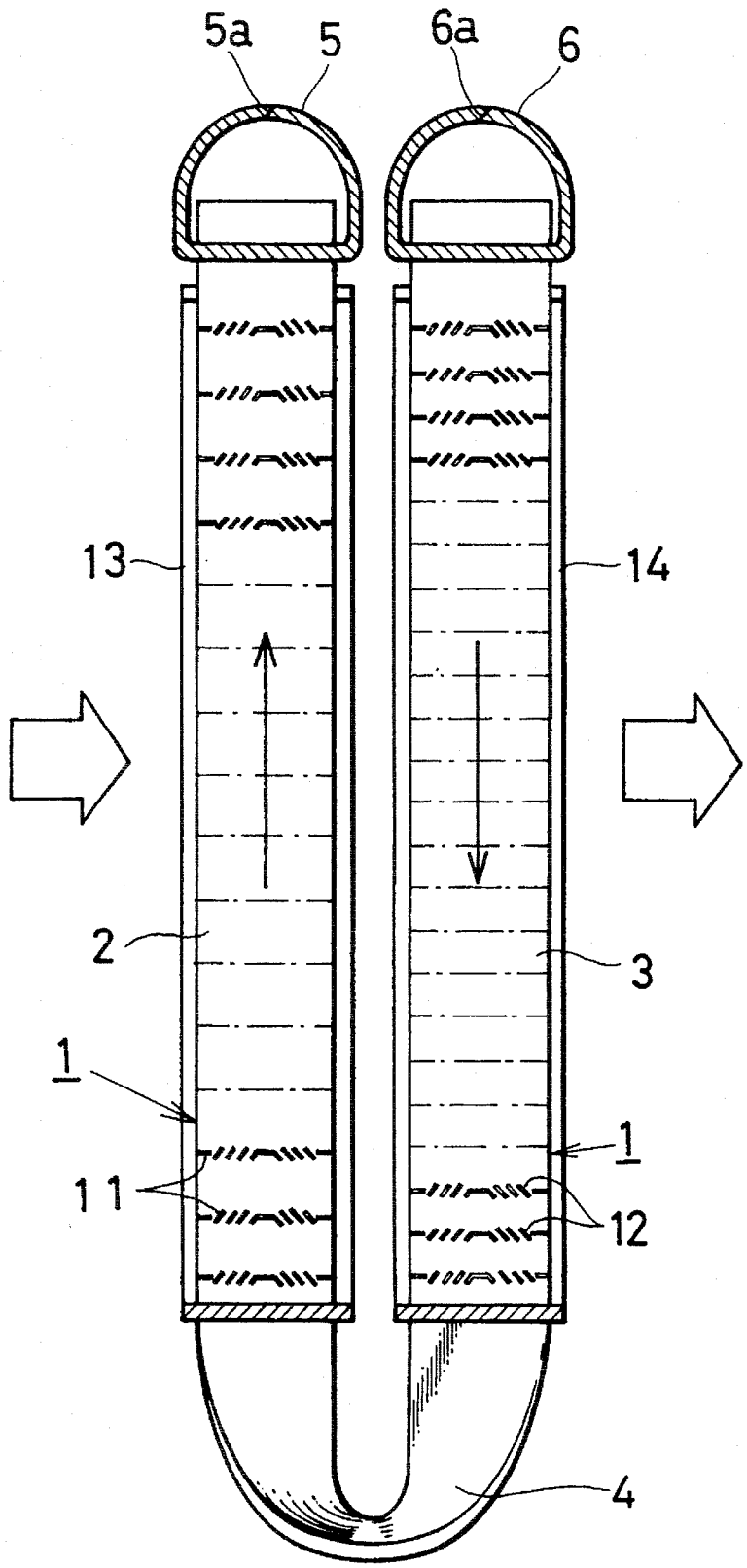
FIG. 2 is a cross section taken along the line 2—2 in FIG. 1.
Figure 3:
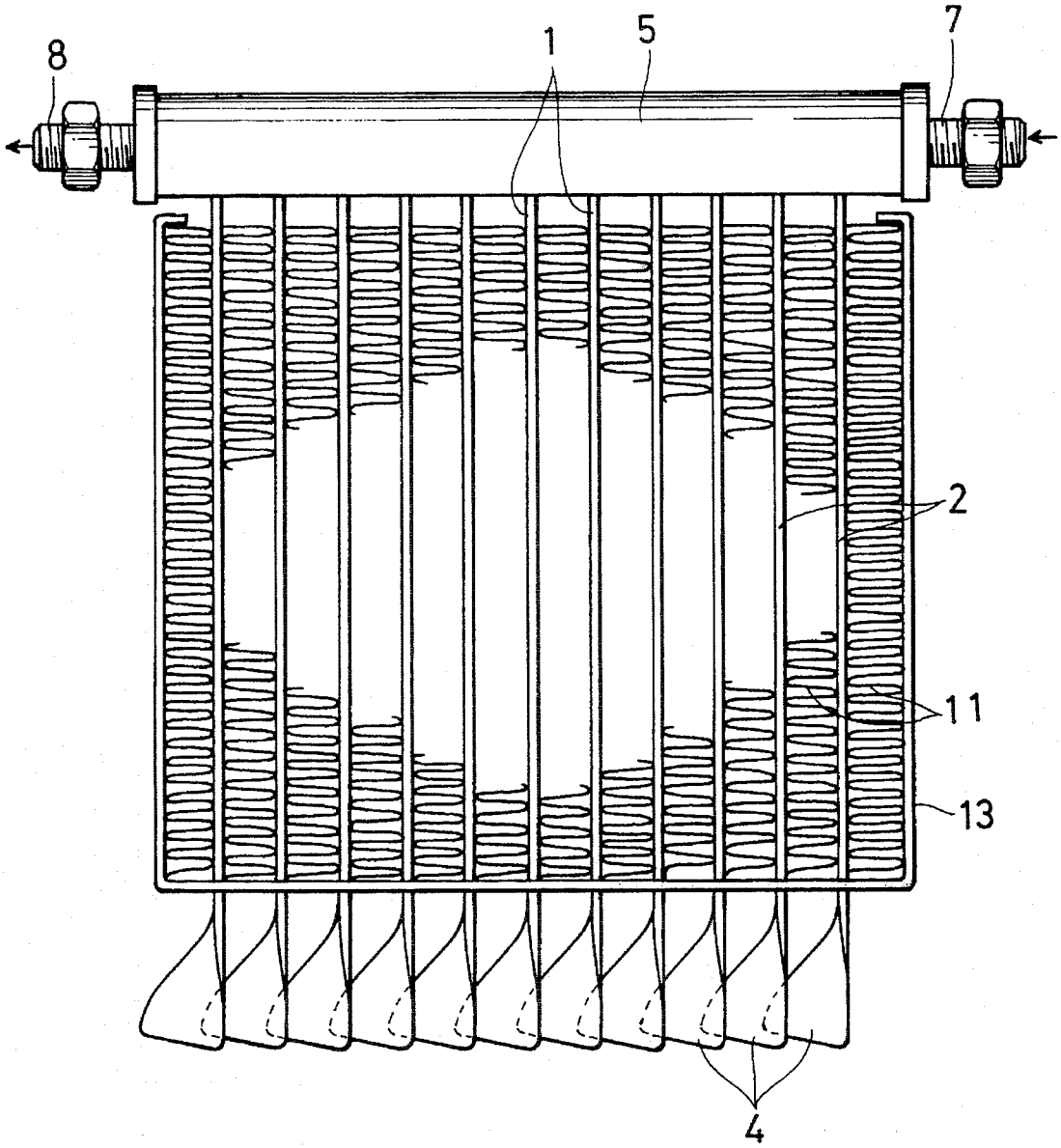
FIG. 3 is a front elevation of the heat exchanger.
Figure 4:
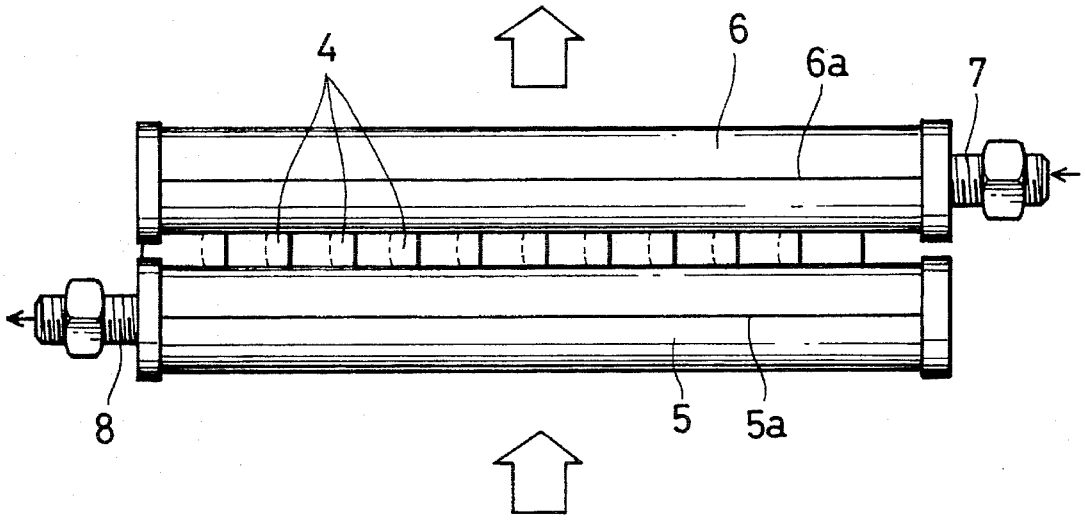
FIG. 4 is a plan view of the heat exchanger.
Figure 5:
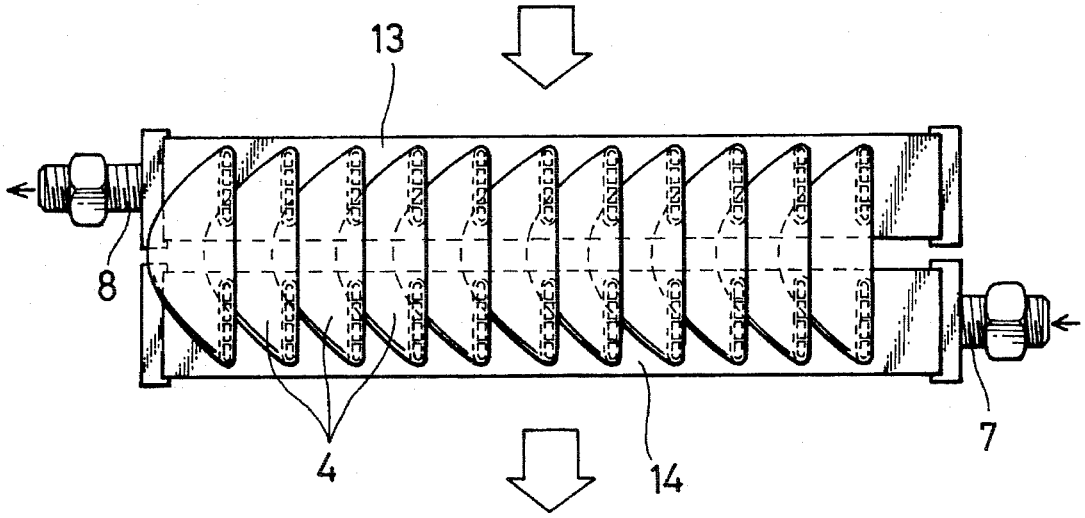
FIG. 5 is a bottom view of the heat exchanger.

Each of the flat tubes 1 shown in FIGS. 1 and 2 has straight sections 2 and 3 and a middle portion 4 integral with and intervening between them. This middle portion 4 is bent and twisted to have a predetermined helical angle relative to the straight sections. In this embodiment, the bent and twisted middle portion 4 is generally U-shaped such that the straight sections 2 and 3 of each tube extend in parallel with each other and are included in a common plane.

The tube 1 may not be bent into a U-shape but into a V-shape or the like such that the straight sections 2 and 3 extend at a predetermined angle relative to each other. Further, the bent and twisted portion 4 may not necessarily be positioned right in the middle of each tube.

Figure 6:
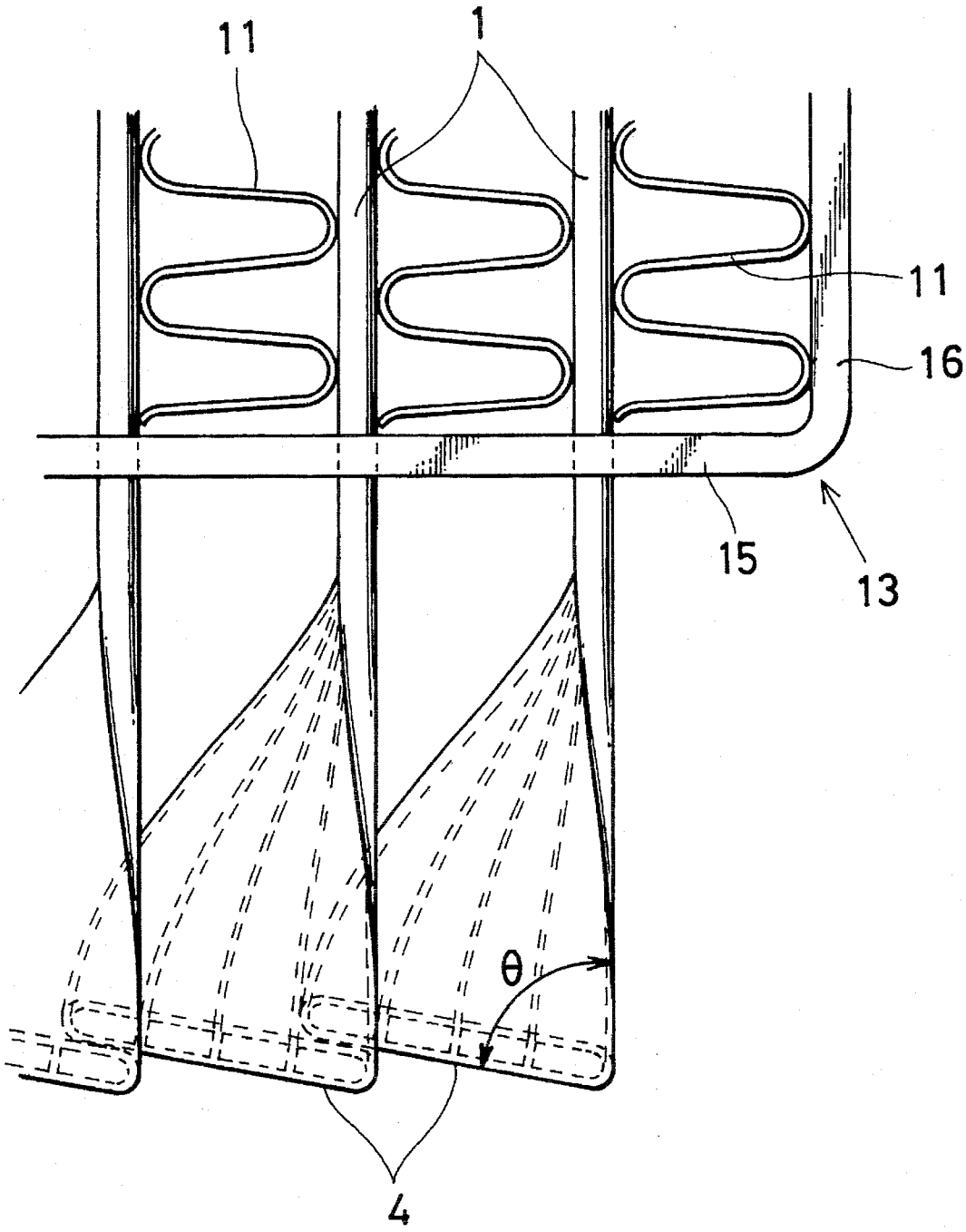
FIG. 6 is an enlarged and partial front elevation of the heat exchanger's portion where tubes are bent and twisted.

An outer edge of the bent and twisted portion 4 lies almost in parallel with the straight sections 2 and 3, as shown in FIG. 6. A helical angle θ defined between the bent portion and each straight section is predetermined to be slightly smaller than 90° C.

The bent portion 4 preferably of a smooth and arcuate contour is usually designed as short as the torsional strength allows. Any specific configuration and radius of curvature may be employed so long as the internal flow path of tube substantially remains non-collapsed and has an unconstricted cross-sectional area.

The generally U-shaped flat tubes 1 having at their bottoms the bent and twisted portions 4 are arranged such that their vertical straight sections 2 and 3 are located side by side and at regular intervals. Aluminum hollow headers 5 and 6 are connected to upper ends of the flat tubes.

As seen in FIG. 6, the bent portions 4 of the adjacent tubes 1 overlap and fit on each other so as to support one another and improve their strength. Those bent portions may be brazed or otherwise secured one to another to further raise the strength.

Fins such as aluminum corrugated fins 11 are disposed between the adjacent straight sections 2 located windward and also outside the outermost straight sections 2. Similar fins 12 are disposed between the adjacent straight sections 3 located leeward and also outside the outermost straight sections 3. Those fins are brazed to the straight sections 2 and 3. Fin pitch of the windward fins 11 is greater than that of the leeward ones 12.

A front reinforcing strip 13 is secured to and surrounds the group of windward straight sections 2, while a rear reinforcing strip 14 being likewise secured to and surrounding the group of leeward straight sections 3. Each reinforcing strip is made by bending an elongate plate, and has a middle section 15 and end sections 16 bent upward and extending therefrom so that it assumes a U-shape in front elevation.

Figure 7:
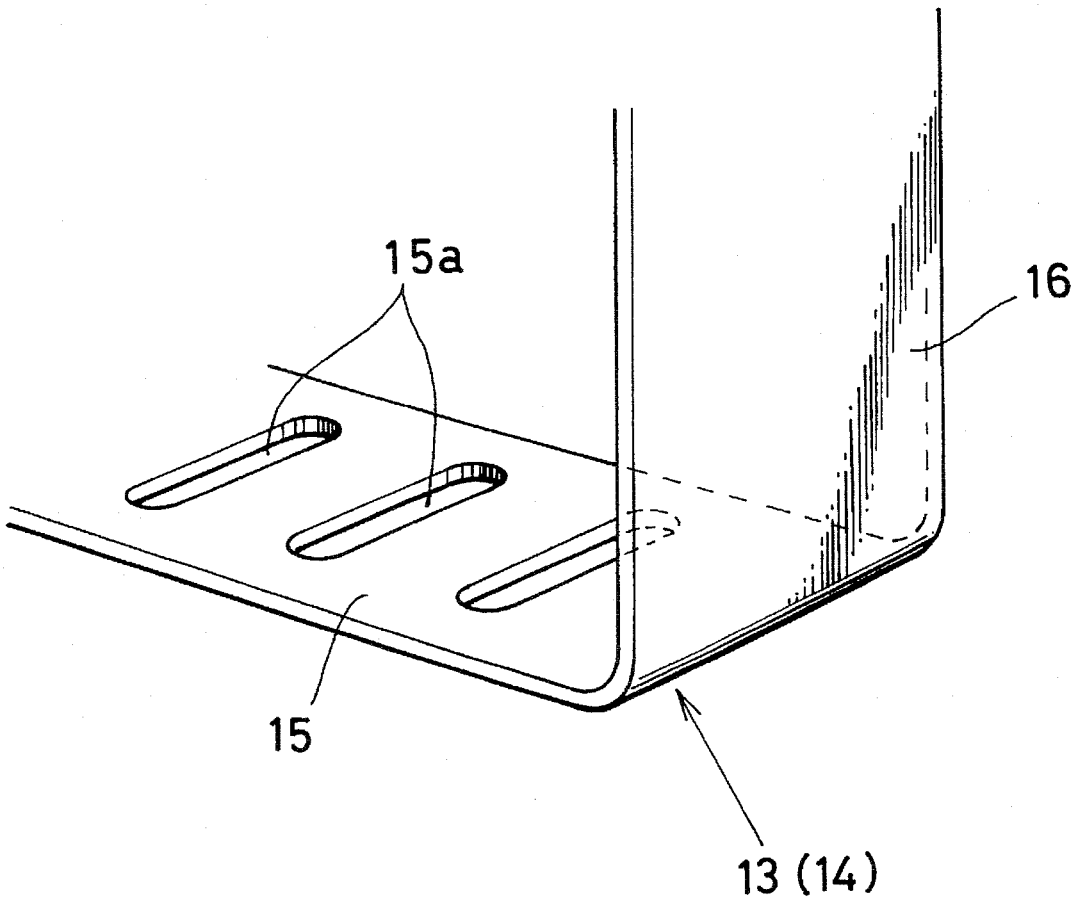
FIG. 7 is an enlarged and partial perspective view of a reinforcing strip incorporated in the heat exchanger.

As shown in FIG. 7, apertures 15*a* are formed through the middle section 15 at a pitch corresponding to the flat tubes 1. A boundary between the bent portion and the straight section 2 or 3 is brazed to and held in the corresponding aperture 15*a* in which the tube 1 is inserted.

Each of the end sections 16 is in contact with and brazed to the fin 11 or 12 which is located outside the outermost tube 1. It is preferable that, in order to facilitate the brazing process, the reinforcing strips are made of a sheet which is composed of a core having either or both surfaces clad with a brazing agent layer.

The reinforcing strips 13 and 14, which contribute to an improved strength of the core of this heat exchanger, circumscribe the bending and twisting action within narrow bounds. The tubes' straight sections are thus protected from any torsion or bending.

Figure 13:
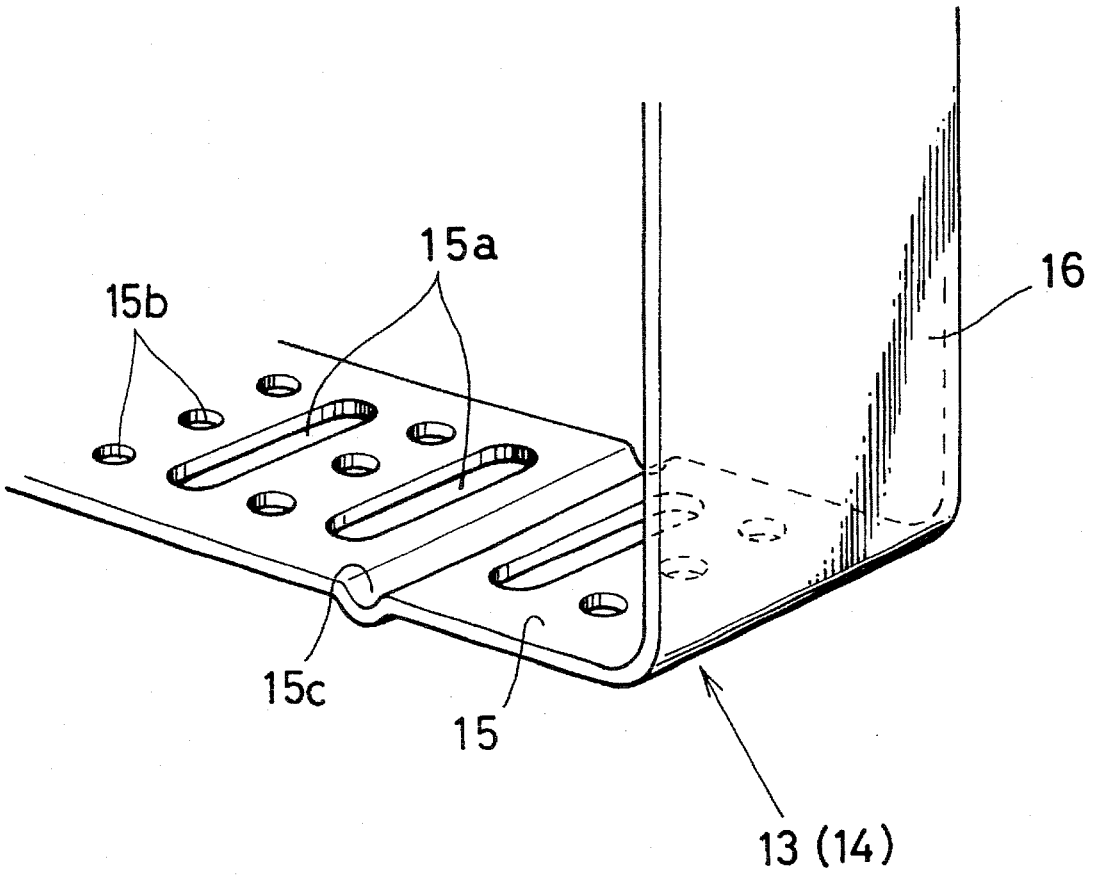
FIG. 13 is an enlarged and partial perspective view of a modified reinforcing strip.

The middle section 15 of each reinforcing strip 13 and 14 may have drainage holes **15*b* formed therethrough and/or drainage trough portions 15*c*, as shown in FIG. 13**, which will prevent stagnation of the condensed water.

The headers 5 and 6 are made of an aluminum brazing sheet composed of a core which has either or both sides clad with a brazing agent layer. In manufacture, the brazing sheet is rolled into a cylinder having abutment edges which are subsequently seam welded. Each header has a cross section of generally 'laid-down D-shape' such that a flat bottom receiving the tubes continues to an arcuate dome, as seen in FIG. 2. Although this shape may be somewhat inferior to a circular cross section in respect of resistance to a high internal pressure such as operating in condensers, those headers can withstand well a medium internal pressure operating in evaporators.

Such a specific cross-sectional shape of the headers is advantageous in that ends of each tube 1 need not be inserted so deep as to reach an axis of the header, contrary to the case of using headers of a circular cross section. Thus, an effective length of each tube 1 is made greater to thereby increase the effective area of the core.

Figure 11:
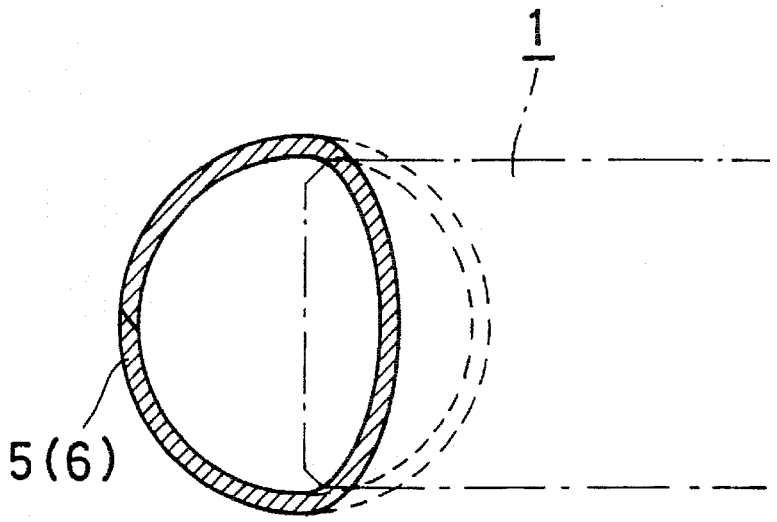
FIG. 11 is a cross section of a modified header incorporated in the heat exchanger.

Alternatively, the headers 5 and 6 may have a cross section composed of a semi-ellipse and a semicircle, with the former receiving the tube ends as shown in FIG. 11. This modification will also be advantageous from the viewpoint as mentioned above.

Figure 12:
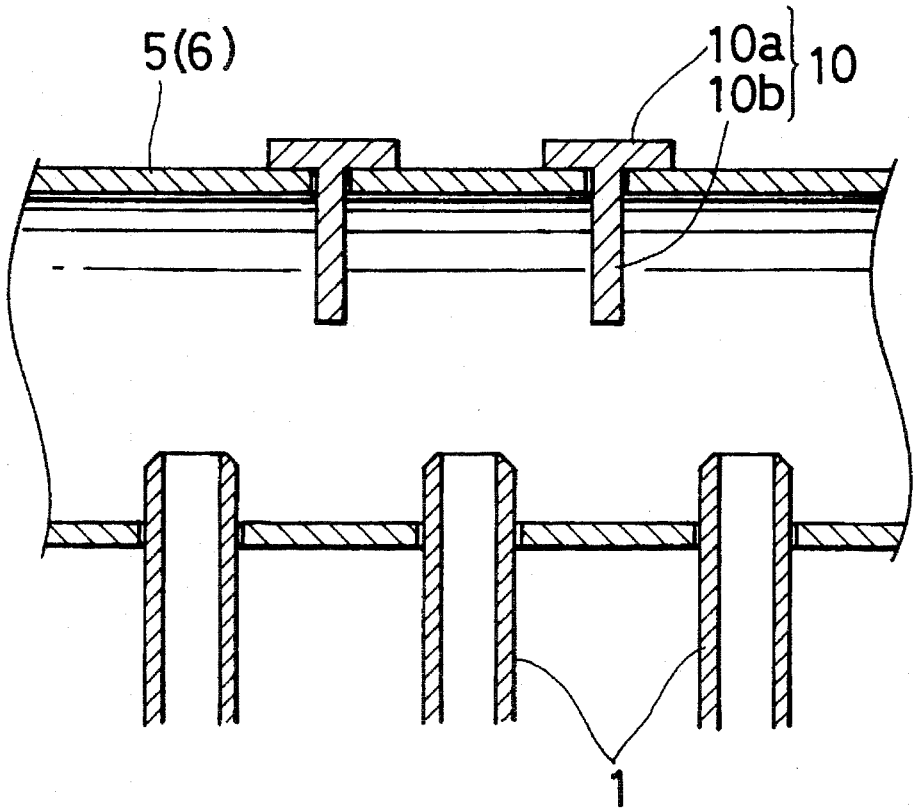
FIG. 12 is a cross section of a modification in which baffles are inserted in the header.

FIG. 12 shows baffles 10 each secured to a part of cylindrical wall of each header 5 or 6, wherein the part is opposite to another part in which the tubes 1 are secured. Each baffle 10 is located between the adjacent tubes and comprises a base **10*a* and a leg 10*b*. This leg 10*b* protrudes inwardly towards the tubes' ends so that the heat exchanging medium is smoothly and evenly distributed into the tubes. The base 10*a* is fixed to an outer peripheral surface of the header 5 or 6**.

In use, the heat exchanging medium will flow into a leeward one of the headers 6 through an inlet pipe 7 liquid-tightly connected thereto. Tributaries of the medium will flow through the respective tubes 1, each making a U-turn to enter the windward header 5, as indicated at the arrows in FIG. 1. The tributaries through the tubes 1 join one another in the windward header and leave it through an outlet pipe 8, after heat exchange has been effected between the medium and air streams penetrating this heat exchanger from front to rear as shown by the white arrows.

Figure 14:
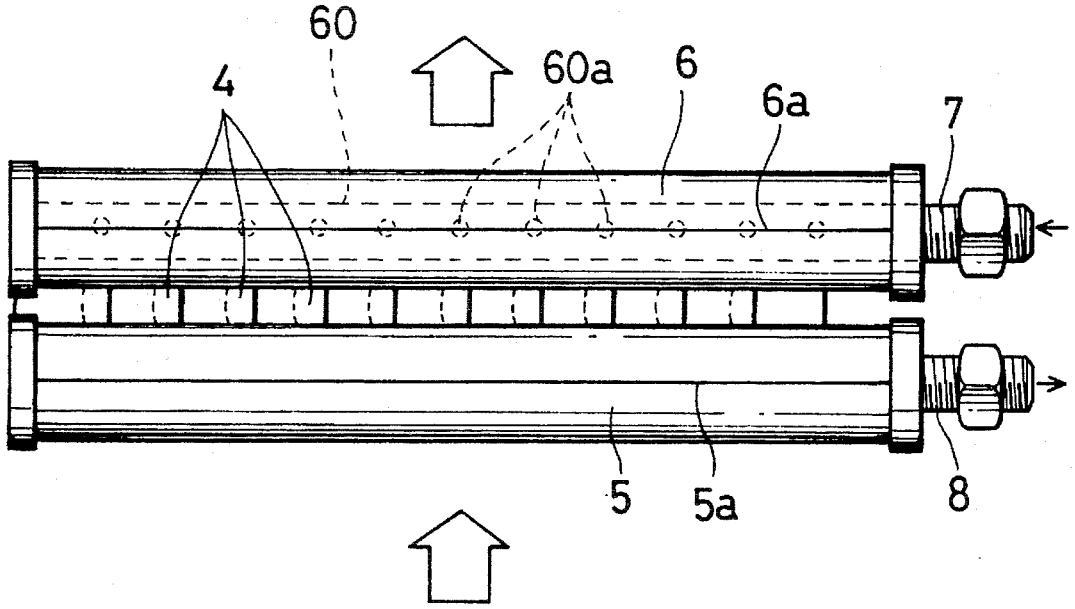
FIG. 14 is a plan view of a modified heat exchanger.

The inlet pipe 7 and outlet pipe 8 may be attached to the headers at their ends located side by side, as shown in FIG. 14, so that the heat exchanging medium can flow into and out of the same side end of the heat exchanger. Further, an internal pipe 60 having small holes **60*a* corresponding to the tubes may be secured in and coaxially of the inlet side (viz. leeward) header 6. Such an internal pipe connected to the inlet pipe 7** will ensure an even distribution of the heat exchanging medium into the tubes.

The described heat exchanger may be manufactured, for example in the following manner.

Figure 8A:
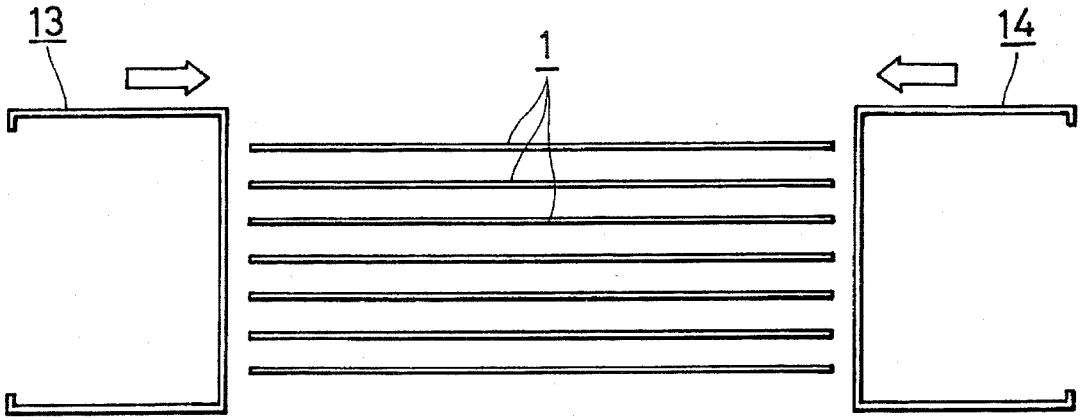
FIGS. 8A, 8B and 8C show the successive steps carried out in this order to manufacture the heat exchanger.
Figure 8B:
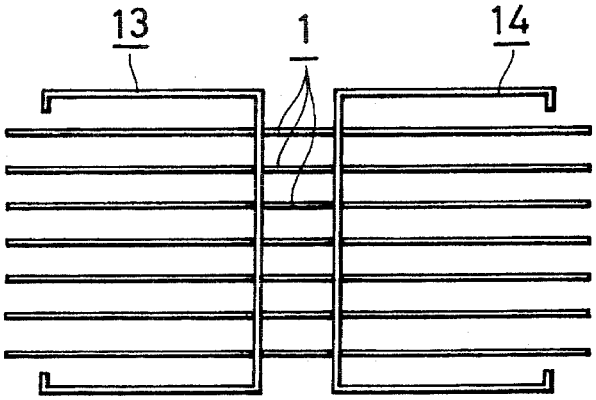
Figure 8C:
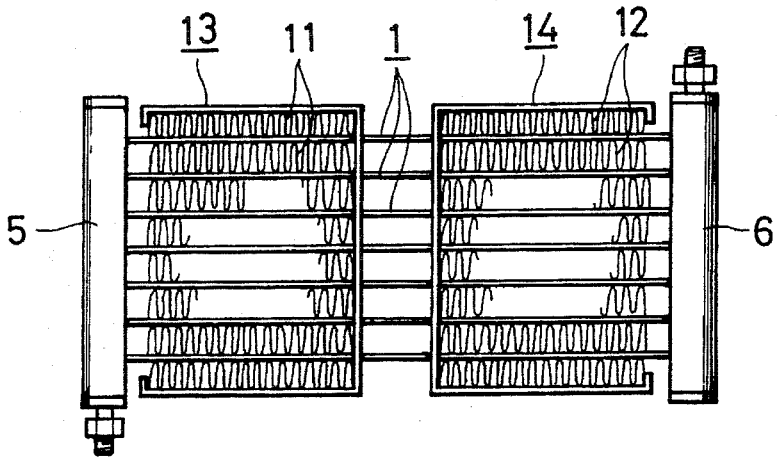

Flat and straight aluminum tubes 1 which are prepared by extrusion will be arranged in parallel and at regular intervals in a direction of their thickness, in a manner shown in FIG. 8A. Next, the tube ends are caused to penetrate the reinforcing strips 13 and 14, which will then be put closer to each other as shown in FIG. 8B. Subsequently, the headers 5 and 6 are adjoined to the tube ends into fluid communication therewith, and the corrugated fins 11 and 12 are set in between the adjacent tubes 1 and also between the outermost tube and the end section 16 of the reinforcing strip as shown in FIG. 8C. Any brazeable accessories may be attached to the thus prepared assembly which will then be 'one-shot' brazed so that all the parts become integral with each other.

Figure 9:
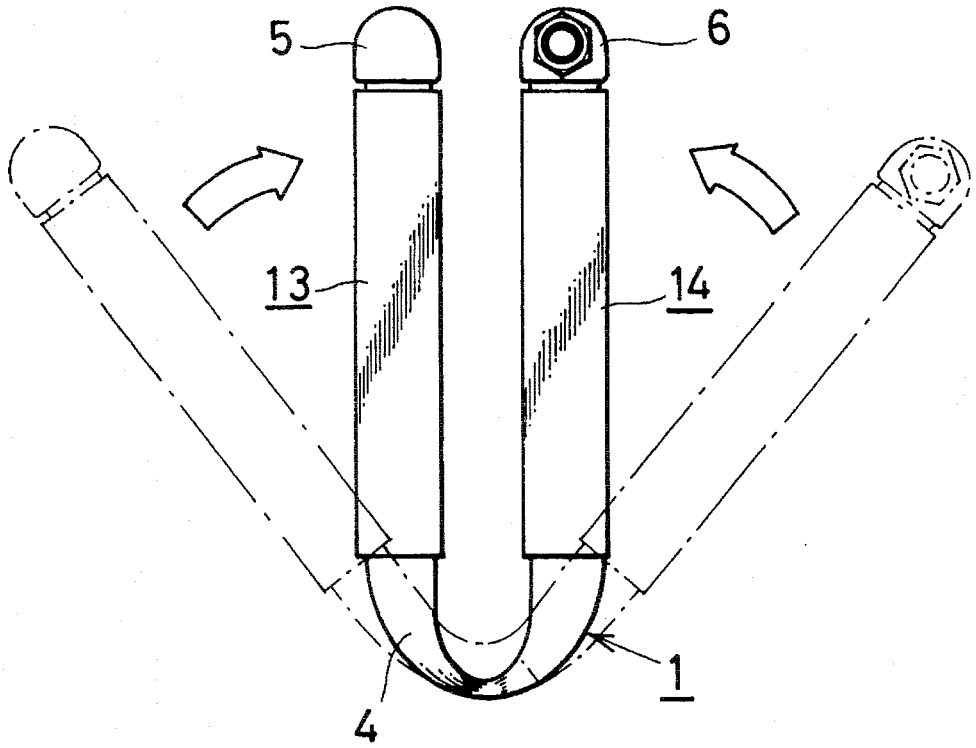
FIG. 9 shows the further step of bending the tubes.

The brazed assembly will further be subjected to the bending process in which each tube 1 is bent at its middle portion in the direction of its thickness, so that its straight sections lie in parallel with each other, as shown in FIG. 9. It may be preferable to use a proper tool to give all the middle portions a slight pretwist which will allow them to readily twist in the same direction.

Thus in manufacture of the heat exchanger, the tubes 1 can easily be twisted in the direction of their width, at any predetermined middle portions 4 and at a predetermined helical angle relative to their straight sections, whether pretwisted to any extent or not.

It is also easy in the present invention to give a small radius of curvature to the bent and twisted middle portions 4 of the tubes 1 so that each of them is bent to assume a U-shape.

Although the straight sections 2 and 3 have their lateral edges facing one another and disposed in alignment with each other, the pitch of windward fins 11 is designed larger than that of leeward ones 12 so that a satisfactory performance is afforded as to the heat exchange.

A higher productivity is realized herein, because the flat heat exchanging tubes 1 are bent all at once after the necessary parts are assembled.

In the described embodiment, the coolant flowing into the leeward header 6 is distributed to all the tubes forming tributaries connected thereto. Those tributaries join one another in harmony in the windward header 5 to construct the so-called 'one pass' system. Partitions may be secured in the headers 5 and 6, if necessary, to form 'plural passes' which cause the heat exchanging medium to meander through the heat exchanger.

It is however noted that the 'one pass' system is more desirable in this type of evaporators as to their heat exchanging performance, as will be apparent from the following.

Figure 15:
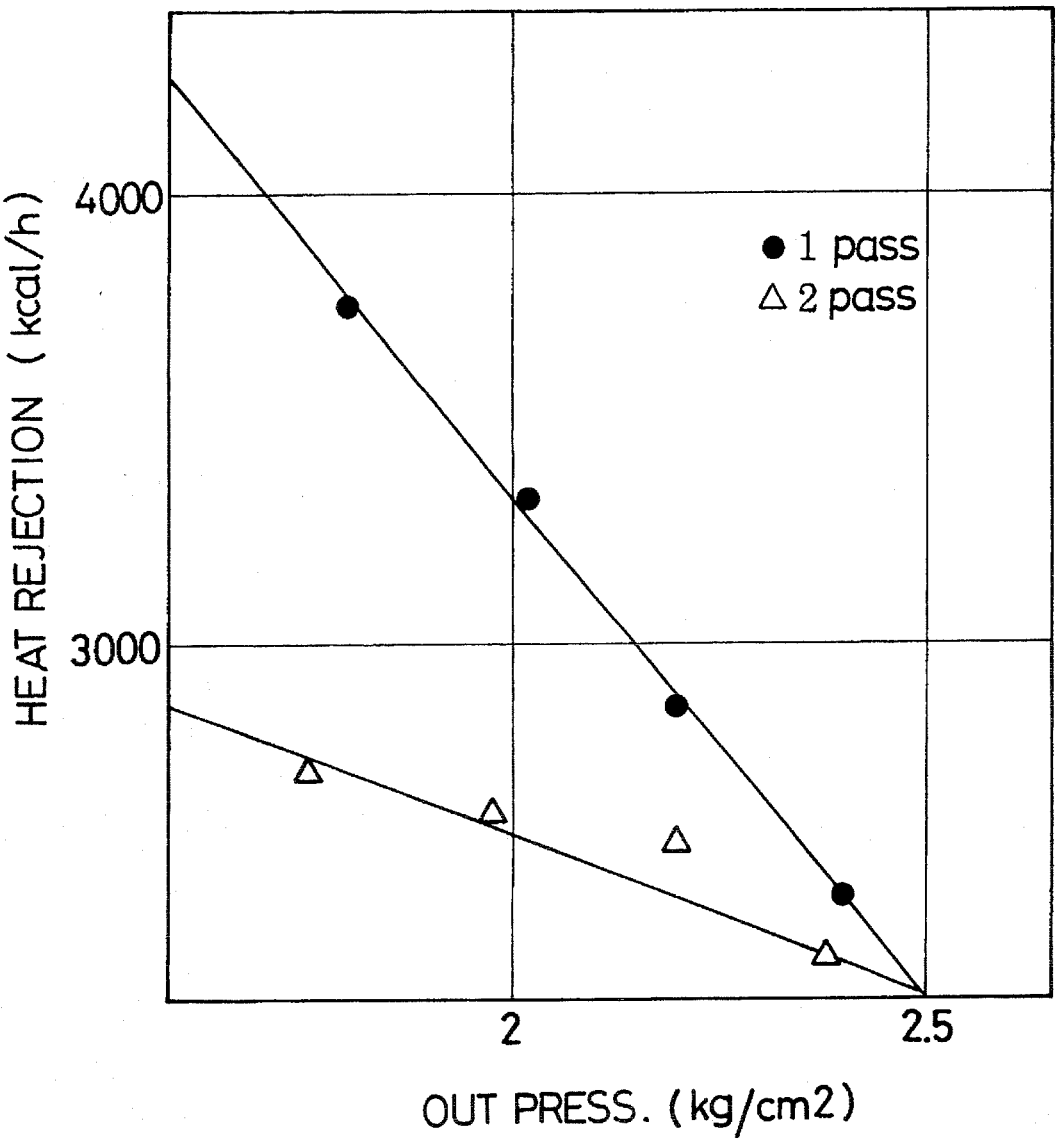
FIG. 15 is a graph showing a relationship observed between the heat rejection and the pressure of a medium at an outlet of the heat exchanger.
Figure 16:
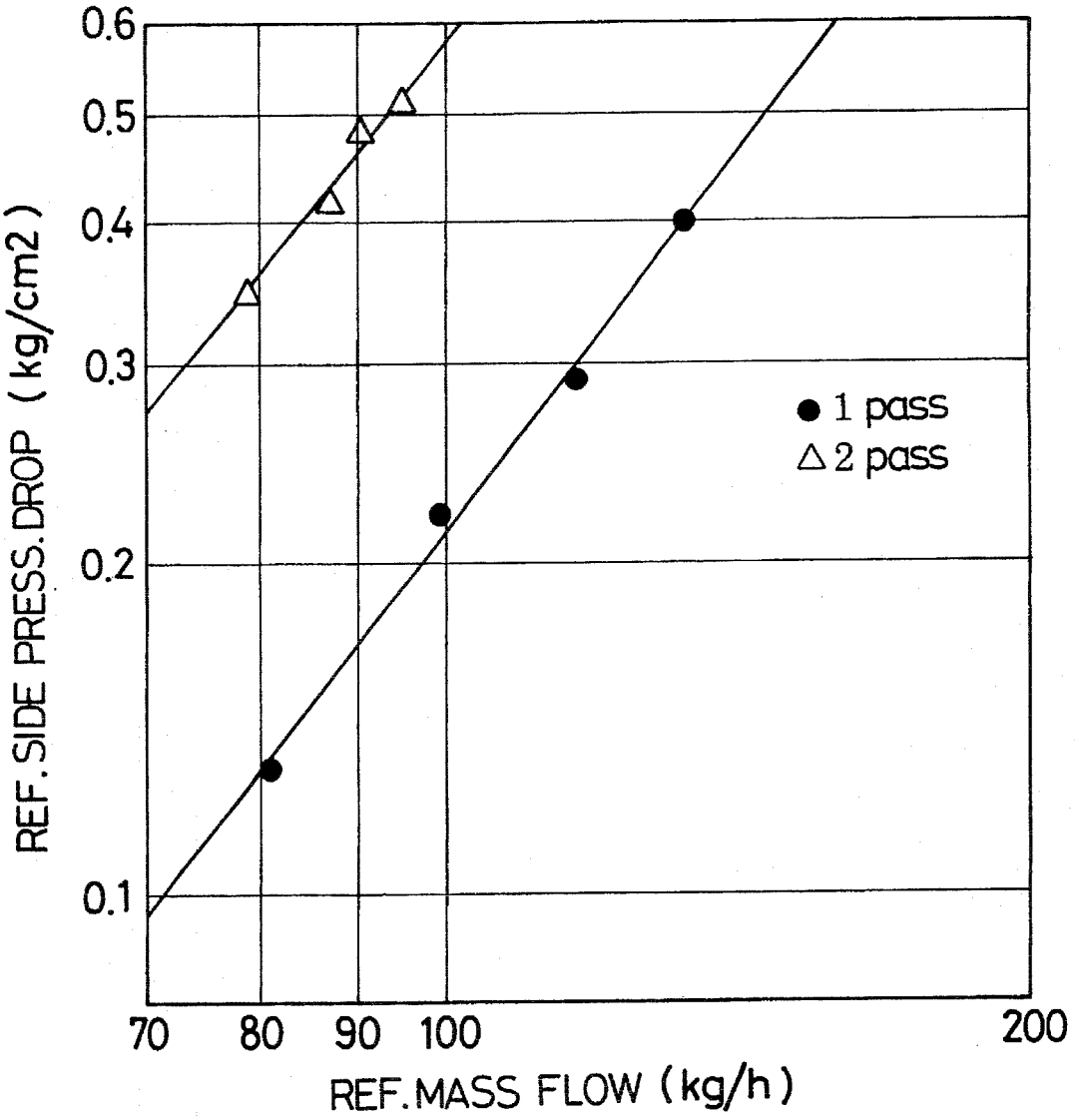
FIG. 16 is another graph showing a relationship observed between the pressure drop of the heat exchanging medium and the flow rate thereof.

Samples of heat exchangers were prepared, which each comprised a core 235 mm high and 258 mm wide so that an effective size of the core was 178 mmH×259 mmW. The tube pitch was set at 11.7 mm, with the number of tubes being 21, each fin being 22 mm wide and 10 mm high, and fin pitch being 1.1 mm. One of the sample heat exchangers was of the 'two pass' type, having the partitions dividing the tubes into a first group of 10 tubes and a second group of 11 tubes. A performance test was conducted using HFC134a as the heat exchanging medium and under the operating conditions that: the temperature of said medium at an inlet of expansion valve was 53.5° C.; dry-bulb temperature of affluent air was 27° C.; wet-bulb temperature of effluent air was 19.5° C.; and 'SH' (super-heating) was 5° C. FIG. 15 shows a relationship observed between the heat rejection (kcal/h) and the medium pressure at outlet (kg/cm$^2$). FIG. 16 shows another relationship observed between the pressure loss of the medium (kg/cm$^2$) and the flow rate thereof (kg/h).

As seen in FIGS. 15 and 16, the evaporator of 'one pass' type was superior to that of 'two pass' type not only in the exchanged heat but also in the pressure loss.

Second Embodiment

FIG. 17 to 21 illustrate the second embodiment of the present invention also applied to an evaporator for use in car air conditioners.

This evaporator is of a structure almost similar to that provided in the first embodiment, but different therefrom in: the cross-sectional shape of headers; the reinforcing strips dispensed with; and the configuration of the tubes' bent and twisted portions. Such differences will be briefed below.

Figure 17:
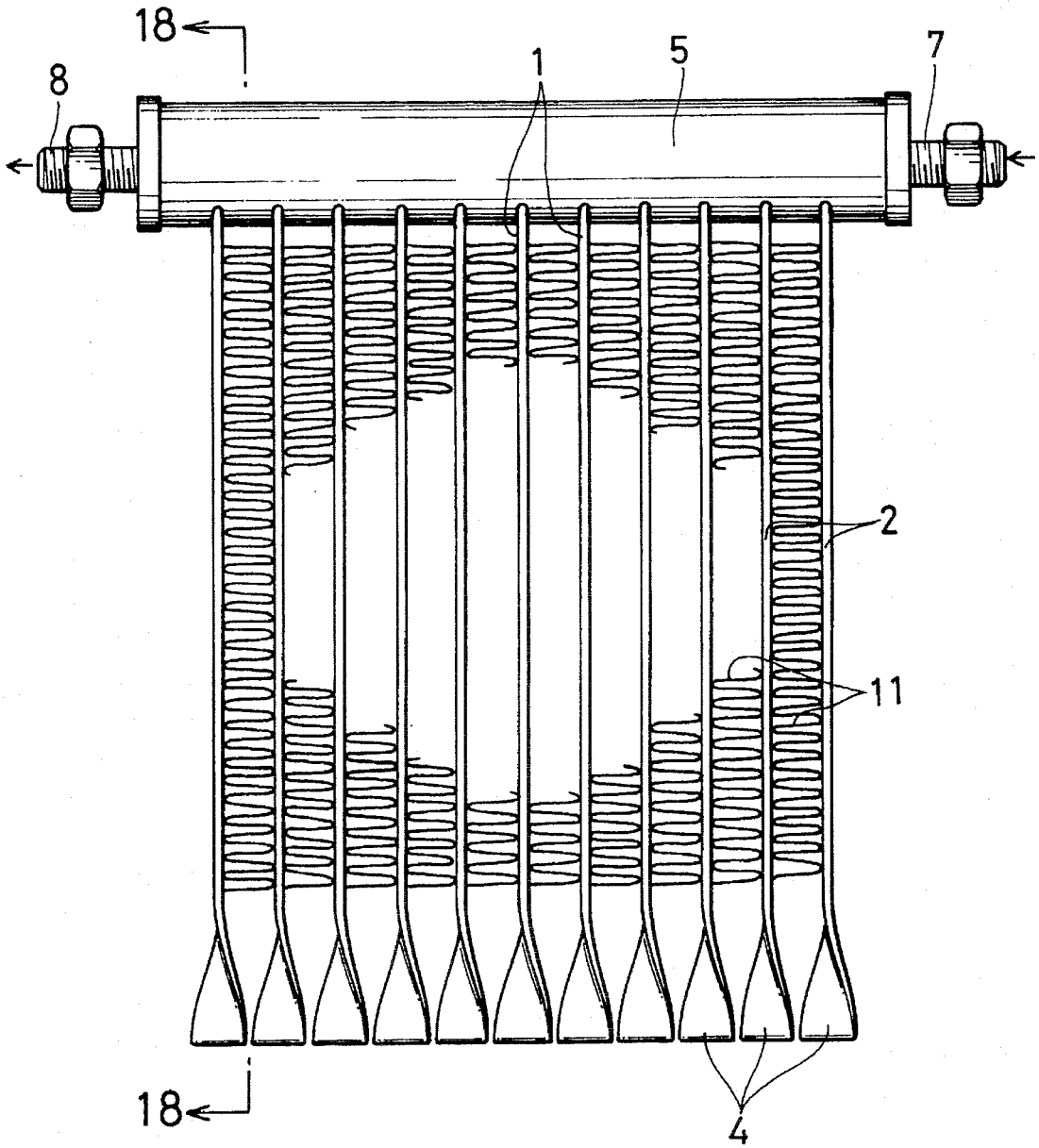
Figure 18:
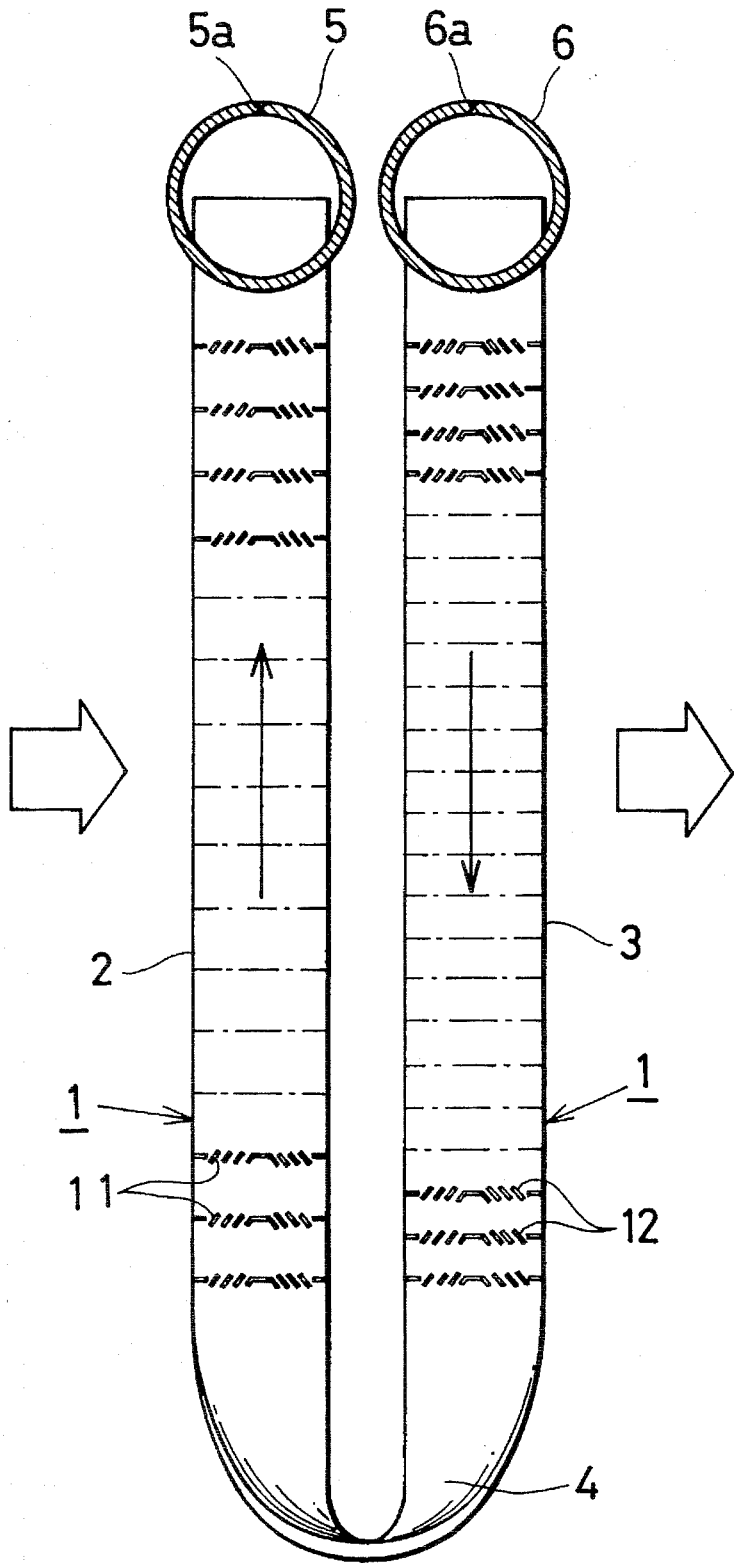

A bottom of each bent and twisted portion 4 of the tubes 1 lies at 90° C., viz. perpendicular, to the straight sections 2 and 3 thereof. The adjacent bent portions 4 do not overlap one another, as seen in FIG. 17.

The headers 5 and 6 are of a round cross section to raise their pressure resistance.

The heat exchanger in the second embodiment does not comprise any reinforcing strips.

Figure 19:
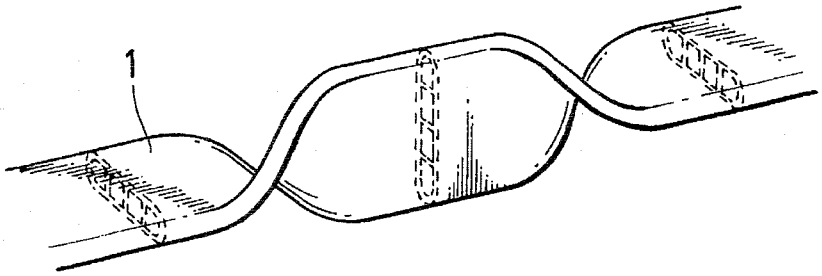
Figure 20:
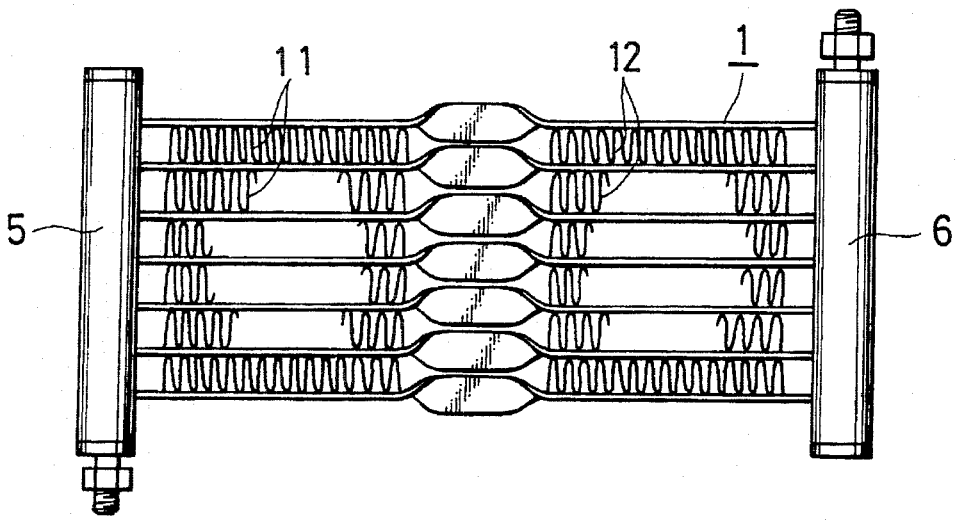
Figure 21:
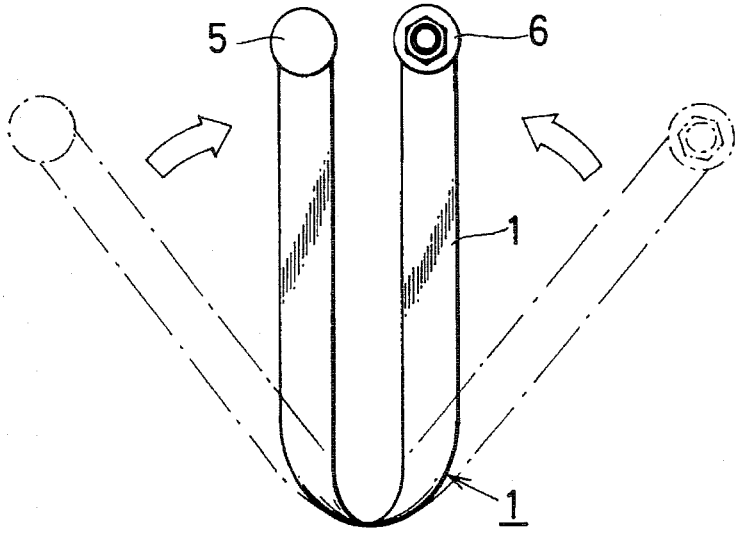

The tubes 1 are preliminarily twisted at first at their middle portions as shown in FIG. 19, before assembled into a state shown in FIG. 20 and subsequently bent in a manner shown in FIG. 21 to provide a finished heat exchanger. It may be possible to twist and simultaneously bent those tubes, also in the second embodiment.

Other features are the same as those employed in the first embodiment, and therefore the same reference numerals are allotted thereto to abbreviate description.

Third Embodiment

A condenser provided in the third embodiment is for use in car air conditioners.

Figure 22:
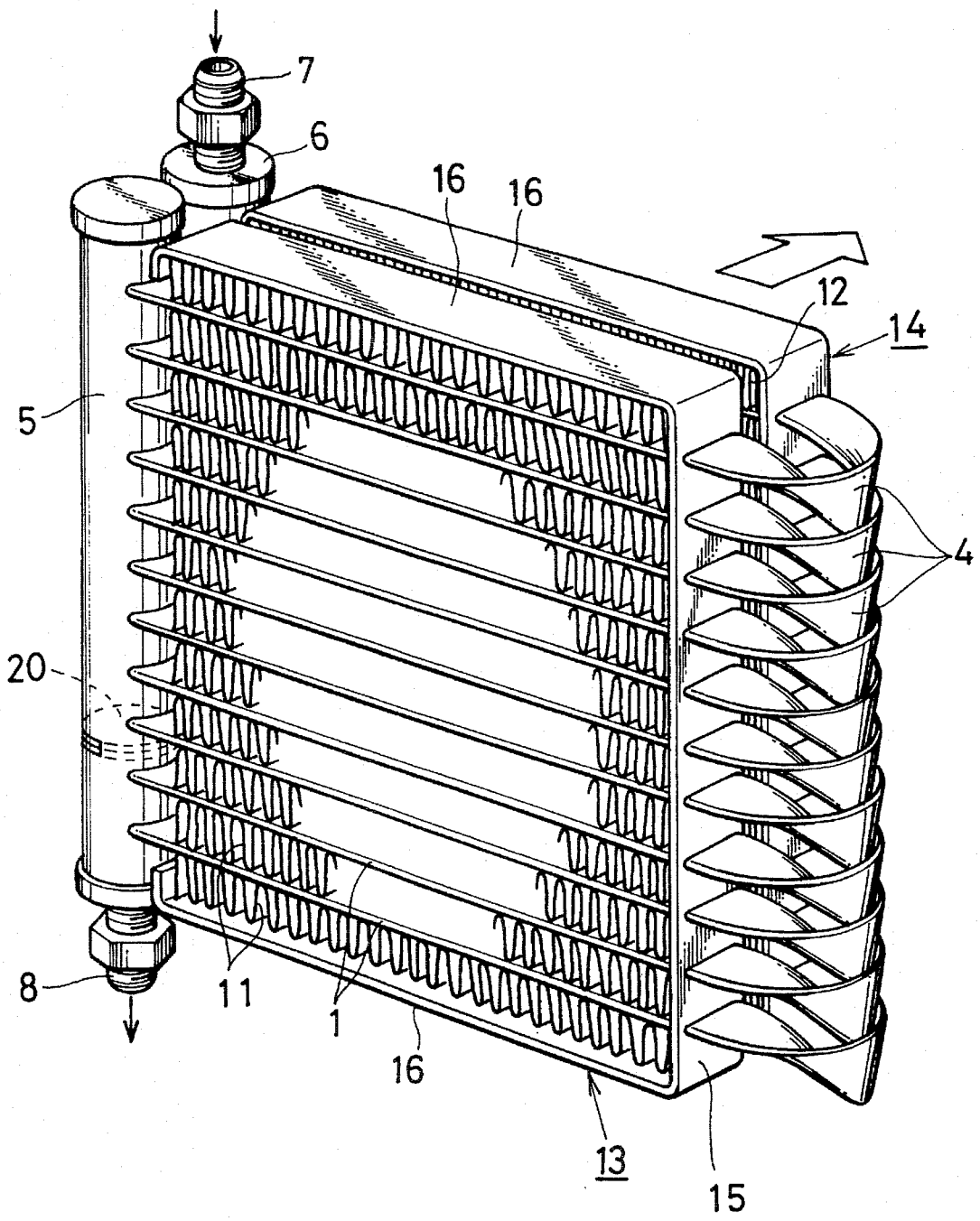
Figure 23:
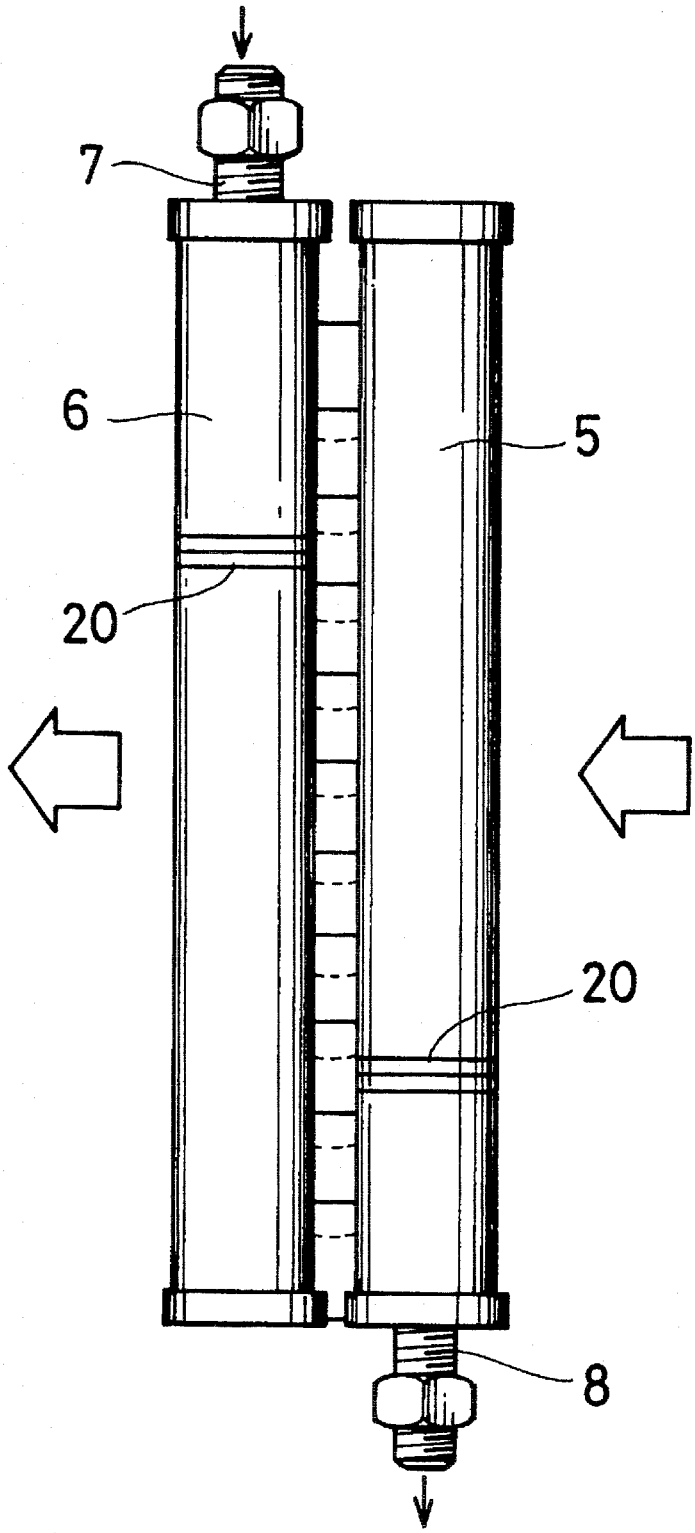

This condenser differs from the evaporators provided in the first embodiment only in that: the headers 5 and 6 stand upright; the straight sections 2 and 3 of each tube 1 are disposed horizontally; each header is of a round cross section; and the partitioning members inserted in headers. The round headers 5 and 6 are adapted for an internal pressure higher than that operating in the evaporators. Each of the partitioning members 20 shown in FIG. 22 divides the interior of header 5 or 6 into longitudinal compartments arranged in a head-to-tail relationship, so that a heat exchanging medium meanders through this condenser.

Other features are the same as those employed in the first embodiment, and therefore the same reference numerals are allotted thereto to abbreviate description.

In summary, each flat tube has its middle portion that is located intermediate its straight sections, bent in the direction of the tube's width and twisted at a predetermined angle relative to the straight sections.

Consequently, it is possible to arrange a plurality of flat and straight tubes in parallel and at regular intervals and to connect the headers to ends of the tubes, before bending them at their middle portions all at once and simultaneously twisting them at the predetermined angle. Thus, the bending-and-twisting operation encounters no technical difficulty and can now be done easily to facilitate manufacture of such 'bent tube' type heat exchangers.

There is no fear of collapsing the bent and twisted portions to result in a reduced cross-sectional area and an increased pressure loss thereof.

In a case wherein the heat exchanger comprises the aforementioned reinforcing strips each composed of the middle section and the end sections continuing therefrom and formed perpendicular thereto, the straight sections are protected from deformation during the bending-and-twisting operation. This is because a stress imparted to the tubes which are being bent is restricted to their middle portions located between the middle sections of said strips, even if each tube is forced to have a considerably small radius of curvature. The reinforcing strips thus contribute not only to an easier manufacture but also to an improved overall strength of the heat exchanger.

The overlapping of the adjacent bent portions will further improve their strength as a whole.

What is claimed is:

1. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes and said bent and twisted portion of each tube is located adjacent said bent and twisted portion of said adjacent tube so that said bent and twisted portion contacts and overlaps said bent and twisted portion of said adjacent tube in order to reinforce said middle section of said tubes;

a pair of hollow headers wherein a first header is disposed at said first ends of said tubes, a second header is disposed at said second ends of said tubes and wherein each header is connected to said tubes so as to be in fluid communication therewith;

a plurality of fins with each fin interposed between said straight sections of said adjacent tubes.

2. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes;

a pair of hollow headers wherein a first header is disposed at said first ends of said tubes, a second header is disposed at said second ends of said tubes and wherein each header is connected to said tubes so as to be in fluid communication therewith;

a plurality of fins with each fin interposed between said straight sections of said adjacent tube;

additional fins disposed outside an outermost pair of tubes of said heat exchanger wherein said outermost pair of tubes have only one said adjacent tube instead of a pair of said adjacent tubes as all inner tubes have; and reinforcing strips with each strip including a middle section and end sections continuing therefrom, wherein said middle section of each reinforcing strip has formed therethrough apertures each fitting on a boundary present between said straight section and said bent and twisted portion of each tube, and each end section of said reinforcing strip extending along and fixedly adjoined to an outer surface of said corresponding additional fin.

3. The heat exchanger as defined in claim 2, wherein said bent and twisted portions of said tubes are located adjacent said bent and twisted portions of said adjacent tubes in order to contact and overlap one another to reinforce said portions.

4. The heat exchanger as defined in claim 1 or 3, wherein said bent and twisted portions of said tube are brazed to said bent and twisted portions of said adjacent tube to be integral.

5. The heat exchanger as defined in claim 1 or 2, wherein said headers are disposed approximately horizontally so that said straight sections of each of said tubes are approximately vertical to render said heat exchanger adapted to operate as an evaporator.

6. The heat exchanger as defined in claim 1 or 2, wherein each of said headers has an unitary interior which is not divided into compartments, so that a heat exchanging medium flowing into said first or second header advances as tributaries flowing in harmony through all said plurality of tubes at once and into another of said first or second header, whereby said heat exchanger is formed as an evaporator of a one pass type.

7. A heat exchanger as defined in claim 1 or 2, wherein the headers stand upright and the straight sections of each tube are disposed horizontally, so as to render the heat exchanger adapted to operate as a condenser.

8. The heat exchanger as defined in claim 1 or 2, wherein said first or second straight sections of each tube is disposed windward, with another of said first or second straight sections disposed leeward, so that a heat exchanging medium flowing into said leeward straight section advances into said windward section.

9. The heat exchanger as defined in claim 1 or 2, wherein each of said pair of headers is of a cross-sectional shape having a flat bottom portion continuing to a rounded portion, so that said flat bottom portion has aperture means for receiving said first and second ends of said plurality of tubes inserted therein.

10. A heat exchanger as defined in claim 1 or 2, wherein each header is of a cross-sectional shape composed of an inner and outer semi-peripheries, and a radius of curvature of the inner semi-periphery receiving the tubes is greater than that of the outer semi-periphery.

11. A heat exchanger as defined in claim 1 or 2, wherein each header is a cylinder of a brazing sheet composed of a core having at least one side clad with a brazing agent layer, and the brazing sheet has abutment edges integrally brazed one to another.

12. The heat exchanger as defined in claim 1 or 2, wherein each tube of said plurality of tubes is bent at a mid-portion of said tube so as to be U-shaped, and so that said first straight section of each tube is in parallel with said second straight section of each tube.

13. A heat exchanger as defined in claim 2, wherein each middle section of the reinforcing strips has drainage means selected from a group consisting of drainage holes and drainage troughs, the holes being formed through the middle section and with the troughs formed therein.

14. The heat exchanger as defined in claim 1 or 2, wherein each tube of said plurality of tubes has an interior which is divided into windward and leeward unit paths located side by side and longitudinally of said tubes, so that a heat exchanging medium flowing through said leeward unit path in one of said first or second straight sections located leeward is guided by said intermediate bent portion into said windward unit path in another of said first or second straight sections located windward.

15. A heat exchanger as defined in claim 1 or 2, wherein the header connected to an inlet pipe of the heat exchanger has an internal pipe secured in and coaxially with the header, the internal pipe being connected to the inlet pipe, and wherein the inlet pipe and an outlet pipe are attached to the headers at ends thereof located side by side.

16. A heat exchanger as defined in claim 15, wherein the internal pipe has small holes corresponding to the tubes so that the heat exchanging medium is distributed evenly into the tubes.

17. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes and said bent and twisted portion of each tube is located adjacent said bent and twisted portion of said adjacent tube so that said bent and twisted portion contacts and overlaps said bent and twisted portion of said adjacent tube in order to reinforce said middle section of said tubes by said bent and twisted portion of each of said tubes being brazed to said bent and twisted portion of said adjacent tube in order for said bent and twisted portions to be integral;

a pair of hollow headers wherein a first header is disposed at said first ends of said tubes, a second header is disposed at said second ends of said tubes wherein each header is connected to said tubes so as to be in fluid communication therewith, wherein said headers are disposed approximately horizontally and said straight sections are disposed approximately vertically so as to render the heat exchanger adapted to operate as an evaporator and wherein each of said headers has a unitary interior which is not divided into compartments so that a heat exchanging medium flowing into said first or second header advances as tributaries flowing in harmony through all said tubes at once and into another of said first or second header, whereby the heat exchanger is formed as an evaporator being of a one pass type;

a plurality of fins with each fin interposed between said straight sections of said adjacent tubes;

additional fins disposed outside an outermost pair of tubes of said heat exchanger wherein said outermost pair of tubes have only one said adjacent tube instead of a pair of said adjacent tubes as all inner tubes have; and reinforcing strips with each strip including a middle section and end sections continuing therefrom, wherein said middle section of each reinforcing strip has formed therethrough apertures each fitting on a boundary present between said straight section and said bent and twisted portion of each tube, and each end section of said reinforcing strip extending along and fixedly adjoined to an outer surface of said corresponding additional fin.

18. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes and wherein one of said first or second straight sections of each tube is disposed windward, one of said first or second straight sections is disposed leeward, so that a heat exchanging medium flowing into said leeward straight sections advance into said windward sections;

a pair of hollow headers wherein a first header is disposed at said first ends of said tubes, a second header is disposed at said second ends of said tubes wherein each header is connected to said tubes so as to be in fluid communication therewith and wherein each header is of a cross-sectional shape having a flat bottom continuing to a rounded section in order for said flat bottom to contain apertures means for receiving said tubes inserted therein;

a plurality of fins with each fin interposed between said straight sections of said adjacent tubes;

additional fins disposed outside an outermost pair of tubes of said heat exchanger wherein said outermost pair of tubes have only one said adjacent tube instead of a pair of said adjacent tubes as all inner tubes have; and reinforcing strips with each strip including a middle section and end sections continuing therefrom, wherein said middle section of each reinforcing strip has formed therethrough apertures each fitting on a boundary present between said straight section and said bent and twisted portion of each tube, and each end section of said reinforcing strip extending along and fixedly adjoined to an outer surface of said corresponding additional fin.

19. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes wherein each tube is bent at said middle section so as to be U-shaped and said straight sections of said tubes are in parallel;

a pair of hollow headers wherein a first header is disposed at said first ends of said tubes, a second header is disposed at said second ends of said tubes and wherein each header is connected to said tubes so as to be in fluid communication therewith;

a plurality of fins with each fin interposed between said straight sections of said adjacent tubes;

additional fins disposed outside an outermost pair of tubes of said heat exchanger wherein said outermost pair of tubes have only one said adjacent tube instead of a pair of said adjacent tubes as all inner tubes have; and reinforcing strips with each strip including a middle section and end sections continuing therefrom, wherein said middle section of each reinforcing strip has formed therethrough apertures each fitting on a boundary present between said straight section and said bent and twisted portion of each tube, and each end section of said reinforcing strip extending along and fixedly adjoined to an outer surface of said corresponding additional fin.

20. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes;

wherein each tube has an interior which is divided into windward and leeward unit paths located side by side and longitudinally of said tubes, so that a heat exchanging medium flowing through said leeward unit path in one of said first or second straight sections located leeward is guided by said bent and twisted portion into said windward unit path in another of said first or second straight section located windward;

a pair of hollow headers wherein a first header is disposed at said first ends of said tubes, a second header is disposed at said second ends of said tubes and wherein each header is connected to said tubes so as to be in fluid communication therewith;

a plurality of fins with each fin interposed between said straight sections of said adjacent tubes;

additional fins disposed outside an outermost pair of tubes of said heat exchanger wherein said outermost pair of tubes have only one said adjacent tube instead of a pair of said adjacent tubes as all inner tubes have; and reinforcing strips with each strip including a middle section and end sections continuing therefrom, wherein said middle section of each reinforcing strip has formed therethrough apertures each fitting on a boundary present between said straight section and said bent and twisted portion of each tube, and each end section of said reinforcing strip extending along and fixedly adjoined to an outer surface of said corresponding additional fin.

21. A heat exchanger comprising:

a plurality of tubes with each tube having an oblong longitudinal cross-section of a predetermined thickness, a first end connected to a first straight section, a second end connected to a second straight section, and a middle section located between said first and second straight sections and including a bent and twisted portion which has been bent and twisted to a predetermined angle relative to each of said first and second straight sections, wherein each of said tubes is arranged in said heat exchanger at regular, spaced apart intervals from and in parallel with an adjacent tube at a predetermined distance in a direction parallel to said thickness of said tubes and said bent and twisted portion of each tube is located near said bent and twisted portion of said adjacent tube so that said bent and twisted portion contacts and overlaps said bent and twisted portion of said adjacent tube in order to reinforce said middle section of said tubes;

wherein each tube has an interior which is divided into windward and leeward unit paths located side by side and longitudinally of said tubes, so that a heat exchanging medium flowing through said leeward unit path in one of said first or second straight sections located leeward is guided by said bent and twisted portion into said windward unit path in another of said first or second straight section located windward;

a pair of hollow headers wherein a first header is disposed at said first ends of said tubes, a second header is disposed at said second ends of said tubes and wherein each header is connected to said tubes so as to be in fluid communication therewith; and a plurality of fins with each fin interposed between said straight sections of said adjacent tubes.

* * * * *